United States Patent [19]

Fusaroli

[11] 4,193,254

[45] Mar. 18, 1980

[54] TENSIONING DEVICE FOR A DRIVE BELT FOR CONTROLLING THE ROTATION OF ALIGNED MEMBERS SUCH AS SPINDLES OF TEXTILE MACHINES

[75] Inventor: Goffredo Fusaroli, Milan, Italy

[73] Assignee: S.A.M.P.R.E. S.p.A., Italy

[21] Appl. No.: 966,160

[22] Filed: Dec. 4, 1978

[30] Foreign Application Priority Data

Dec. 6, 1977 [IT] Italy ..... 30504 A/77

[51] Int. Cl.[2] ..... D01H 1/24

[52] U.S. Cl. ..... 57/105; 74/221

[58] Field of Search ..... 57/88, 104, 105; 74/221

[56] References Cited

U.S. PATENT DOCUMENTS

| | | | |
|---|---|---|---|
| 2,210,787 | 8/1940 | Winslow | 57/105 |
| 2,692,474 | 10/1954 | Rogner | 57/105 |
| 3,050,929 | 8/1962 | Stahlecker | 57/105 |
| 3,461,660 | 8/1969 | Nimtz et al. | 57/105 |
| 3,765,161 | 10/1973 | Kohler | 57/105 X |
| 3,974,633 | 8/1976 | Clevenger | 57/105 X |

*Primary Examiner*—John Petrakes

*Attorney, Agent, or Firm*—Shlesinger, Fitzsimmons & Shlesinger

[57] ABSTRACT

This invention relates to a tensioning device for a drive belt for controlling the rotation of aligned members such as spindles of textile machines.

According to the invention, a pressing roller is mounted at one movable end of an elastic support formed by two parallel tapes of hardened steel the confronting ends of which are fixed in equi-spaced relation by two spacers, while the other end of the support is rigidly fastened to the machine, so that the axis of the pressing roller is displaceable parallel to itself.

4 Claims, 9 Drawing Figures

VI
VI
5
6
8
8
5
8
5
X
Y
9
10
10
10
10

VI
VI
6
5
5
X
Y
8
10
8
9
10
8
8
10
8
10

10
8
3
9
5
1
2
7
4
6

3
5
a
b
11
1
2
c
d
7
4

TENSIONING DEVICE FOR A DRIVE BELT FOR CONTROLLING THE ROTATION OF ALIGNED MEMBERS SUCH AS SPINDLES OF TEXTILE MACHINES

In machines working textile fibers there are aligned members that have to rotate generally at high speeds and without sensible differences of revolutions per minute between one another, for instance spindles of spinning and twisting machines, or the rotors of modern open end spinning machines.

In the specification of this invention reference is made by way of example to the spindles of ring spinning machines. Generally such spindles are made to turn in groups of two or four, by means of small belts, so-called "spindle tapes" or "spindle bands," by means of a shaft placed at the center of the machine and over its whole length on which there are keyed big pulleys, one for every group of spindles, and with the aid of tension rollers and diverting rollers to create a sufficient contact of the spindle tapes with the spindles and to direct them in the correct direction and to avoid slipping off. It should be noted, however, that reversal of the rotation of the spindles is not always possible because the spindle tapes slip off, the diverting rollers being provided so as to turn in one direction and not in the other direction of rotation.

The inconveniences of such a control system for driving the spindles are as follows:

(a) the need of a well balanced shaft and well balanced pulleys to avoid vibrations;

(b) the heavy ventilation generated by the numerous pulleys of relevant diameter creating air whirls and making fibers fly off the materials being treated, said flying fibers covering the paths of the machine in considerable layers; as a consequence there arises the need of air blowing means sliding along the fronts of the spinning machines to take away the dust from them.

Another inconvenience is the breakage of the spindle tapes which occurs frequently and causes the contemporaneous stopping of groups of two or four spindles. It is not very easy to replace such spindle tapes being an operation requiring a certain time and causing an impairment of the efficiency of the machine.

With old-fashioned twisting machines the rotation of the spindles was controlled by a continuous belt running along one front of the machine and returning to the control head along the other front. However, in order that the belt might adhere to all of the spindles it was necessary for the latter to be placed, from one wall of the machine to the other, e.g. every six or eight spindles in a span, instead of being aligned, in an arc of a circle and at the walls there had to be provided fixed rollers in suitable positions so that in every span the belt could adhere to the respective spindles.

In ring spinning machines the spindles have to be absolutely aligned. Moreover a necessary condition that cannot be disregarded is the possibility of carrying out the automatical change of the full cops or the automatical piecing up of broken threads.

To drive aligned spindles by means of a continuous belt running longitudinally along each front of a machine, one has to have tensioning devices available after every spindle or after every two spindles, to ensure the adherence of the belt to the spindles.

The rotation of the spindles of one front may be independent of the rotation of the spindles of the other front.

In this case two independent belts are provided, one on each front; or the spindles of the two fronts may be driven by one single belt respectively with the to and fro movement with respect to the control head.

The advantages of that method of making the spindles turn are evidenced by the following facts:

(a) the suppression of a quick shaft along the whole machine reduces vibrations;

(b) many pulleys are dispensed with for the driving of every group of two or four spindles which owing to working tolerances may have small differences of diameters and, therefore, different revolutions per minute of the various groups of spindles;

(c) the efficiency of the machine is increased; whilst the spindle tapes driving the spindles in small groups have a duration of only some hundreds of hours, the continuous belt with straight movement lasts several years;

(d) ventilation and air whirls are reduced thanks to the elimination of the big and numerous pulleys driving the groups of spindles; ventilation may be even completely avoided since it is possible to protect the continuous belt with its tensioning devices in a casing.

Each of said tensioning devices presses with an elastic pressure a roller supported on ball bearings or on roller bearings against the belt running longitudinally and tangentially with respect to the spindles so as to ensure adherence sufficient to make them turn. Since the diameter of the whirl of the spindle is made with very narrow tolerances and since the continuous and non-extensible belt has the same speed at any one of its points, as a consequence also the spindles will turn all with the same number of revolutions per minute.

It is an essential element that the tensioning device, besides being simple and cheap, should have the main feature of pressing the roller by just the amount needed to have the belt move the spindle and at the same time to displace its axis of rotation so as to remain parallel to itself and in a plane normal to the direction in which the belt runs. The requirement that the axis of rotation of the rollers should be displaced strictly parallel to itself is due to the requirement that the belt should not shift towards either side with respect to the running direction. Moreover the displacement should take place in a plane perpendicular to the axis of alignment of the spindles in order not to change the relative distance of the pressing roller with respect to the spindles between which it is provided, e.g. at the centre of the distance between two spindles.

Said distance could not be kept if the pressing roller were displaced along a circular path with its centre more or less far away from it (according to the gauge of the spindles) and from the tangent to the spindles representing the path of the belt.

It is obvious that with the above conditions the direction of the travel of the belt may be indifferently from the right to the left, and the rotation of the spindles can be reversed without causing the belt to slip off.

To exert the elastic pressure it is convenient to adopt a tape of hardened steel of determined thickness width and length so as to exert a pressure being constant and proportional to its diversion. It is known that tapes of hardened steel are—for displacements within a certain limit—means warranting in time the constancy of the reaction to the pressure needed for the same diversion, which is not true with other means such as for instance spiral springs which moreover want to be preloaded to an extent not always easy to be evaluated.

According to the present invention, to obtain displacement of the pressing roller with its axis strictly parallel to itself and perpendicular to the direction in which the belt runs, a couple of tapes is used as a roller support instead of one single tape, said tapes being kept at a certain distance from each other by means of two spacers of the same thickness placed at the two ends of the tapes. One of the ends of the support is anchored to a fixed member and the other end remains free and carries an angle bar on which the pressing roller is fastened, with its axis of rotation parallel to the couple of tapes when they are in their rest or unflexed positions.

Since the two tapes with the two spacers form a support having the configuration of a parallelogram it is apparent that the free end of the support has a linear movement and not a movement of rotation. Since said free end, as said, carries the pressing roller, as a consequence the axis of the latter will effect a displacement parallel to itself.

It should be noted here that if the pressing roller were carried by one tape only, the danger would arise for the displacement of the pressing roller to take place not with its axis parallel to its rest position, namely with the pressure determining the displacement perfectly centred with respect to the width of the tape, but with its axis inclined to one side or the other, with said pressure shifted with respect to the centre of the tape, thereby causing its warping.

By the parallelogram method the displacement of the axis of the roller instead is always parallel to itself, the four sides of the parallelogram remaining equal in any position.

In order that the pressing roller should move othogonally with respect to the direction of the belt, in such a way as not to vary its distance between one spindle and the other spindle, the device is placed vertically if the axis of the spindles is vertical or horizontally if the axis of the spindles is horizontal.

Any elastic means exerting a pressure upon a member in movement, such as in the instant case a pressing roller against a non-extensible drive belt, is subject to vibrations either by resonance or by critical velocity or finally due to small irregularities of construction of the belt. Such vibration is obnoxious in that it prejudices the possibility of ensuring adherence between the driving member and the driven member.

In that case, to obviate the inconvenience as much as possible recourse is had the braking members or to members sliding on fixed walls. According to the present invention the inconvenience can be easily overcome by interposing between the two tapes forming the longer sides of the parallelogram a shim having the shape of a rectangular block and made of elastic material or an elastomer or of another material of appropriate hardness and having the same thickness as the two spacers, whereby the principle of the mechanism does not vary. Thanks to the insertion of the elastic block the variation of the effort for displacing the free end of the parallelogram is substantially insensible and the deformation of the elastic parallelepiped causes a molecular friction in its inmost mass, which has a certain thickness.

Since the resonance of the vibrations of the steel tape is much higher than that of the parallelepiped of elastic material, the latter exerts a braking action onto the former, owing to the adherence of the respective walls, which action completely eliminates the vibrations.

It is evident that tensioning devices according to the invention can be installed in the number of one between successive couples of spindles (minimum) or in the number of one every two spindles (maximum).

A non-extensible belt running in a closed ring tangential to two rotating members and pressed in the middle between them by a pressing roller, to get a sufficient adherence ensuring rotation, forms a certain camber proportional to the tension to which the ring of the belt is subjected.

It is difficult to evaluate, in adjusting the position, in what position the pressing roller has to be placed in order that the diversion of the couple of the tapes of the parallelogram be such as to exert the desired pressure, because one does not know previously the camber that the belt will assume with respect to the tension to which it will be subjected.

Hence according to an advantageous embodiment of the invention there is provided a pointer visualizing, and allowing to measure, the diversion of the tapes so as to enable one to adjust said tension in such a way as to determine the diversion of the tapes by just the amount needed to provide the pressure wanted.

The main features of the device according to the present invention will appear more clearly and with greater detail from the following description of some examples of embodiment illustrated in the accompanying drawings wherein.

Figure 1:
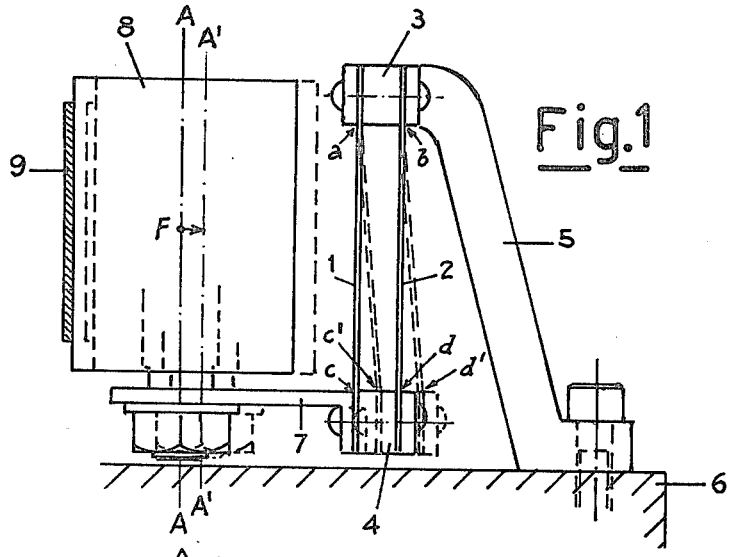
FIG. 1 represents the device in side view with the fixed end of the parallelogram at top.

As diagrammatically illustrated in FIG. 1 the device is composed by two tapes 1 and 2 of hardened steel of suitable length, width and thickness, which are connected at their two ends by means of two spacing shims 3 and 4. Both the couple of tapes and the couple of shims, respectively, are accurately equal to each other. The ends of the tapes are rigidly connected with the spacers, whereby when viewed as in FIG. 1, the confronting surfaces of the tapes and spacers, respectively, are in the configuration of a parallelogram the sides of which, as represented by tapes 1 and 2, exhibit elastic articulation at the points "a" "b" "c" "d."

To the upper spacer 3 there is solidly fixed a support 5 which is anchored on a fixed plane 6 of the machine.

Figure 2:
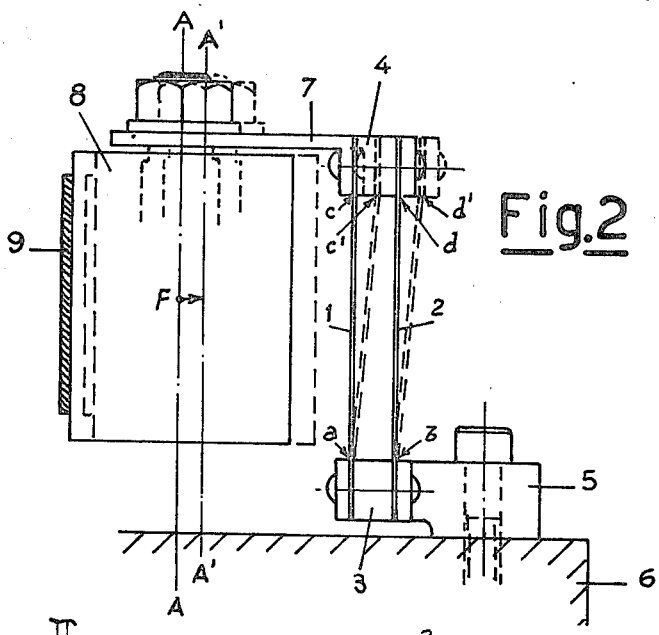
FIG. 2 represents the device in side view but with the fixed end at bottom.

To the lower spacer 4 there is solidly fixed an angular bracket 7 on which there is mounted the pressing roller 8 which is generally a cylindrical roller supported on ball bearings or on roller bearings, already in use in many fields of textile mechanics, with its axis of rotation "A—A" extending parallel to the tapes 1 and 2, when the latter are in their normal or unflexed positions as denoted in FIGS. 1 and 2 by sides "a-c" and "b-d", respectively, of the parallelogram in the rest position of the device.

If this device is mounted in the correct position to exert a determined pressure onto the belt 9, the roller 8 is displaced in the direction of the arrow "F" and the parallelogram representing tapes 1 and 2 assumes the position a-b, c'-d' indicated with dotted lines.

Since the side a-b is fixed, and the sides a-c and b-d are of equal length, the side c-d is displaced horizontally without undergoing a rotation as would be the case if the bracket 7 were fastened to support 5 by only one single tape.

Therefore, in the instant case, also the bracket 7 will be displaced without rotation and consequently the vertical axis of the roller 8 will be displaced to A'—A' parallel to A—A and therefore will remain vertical.

FIG. 2 represents the same device but with its support 5 fastened at the lower spacer 4. The reference numerals and the explanation of operation are the same as with FIG. 1.

Figure 3:
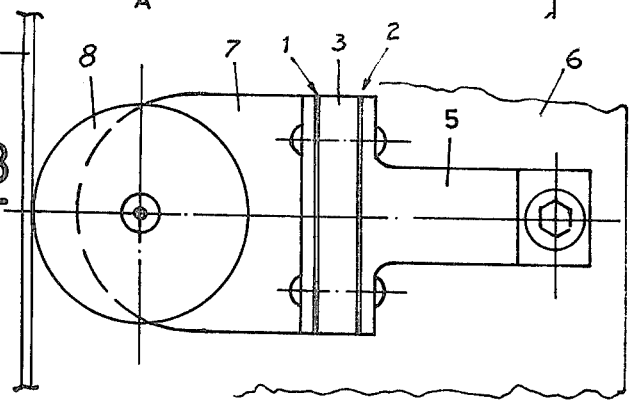
FIG. 3 represents a plan view of FIG. 1.

FIG. 3 is a plan view of FIG. 1 and shows that the tapes 1 and 2 have a certain width to afford a greater stability of the parallelogram.

Figure 4:
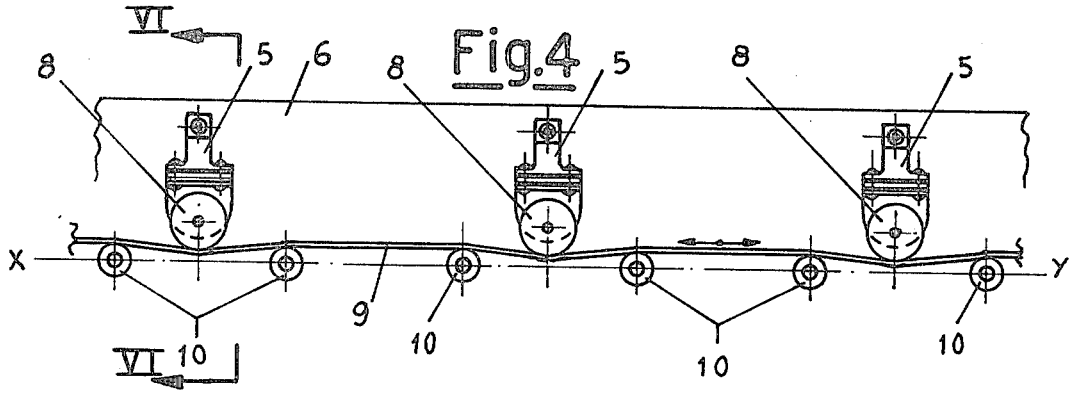
FIG. 4 is a plan view of the arrangement of the spindles longitudinally of the machine, and of the tensioning devices, one after every two spindles.

FIG. 4 represents a plan view of a section of a front of the machine where the spindles 10 are aligned along the axis X-Y, the belt 9 runs parallel to the axis and tangential to the perpheries of the spindles and is pressed there against by the rollers 8.

Figure 5:
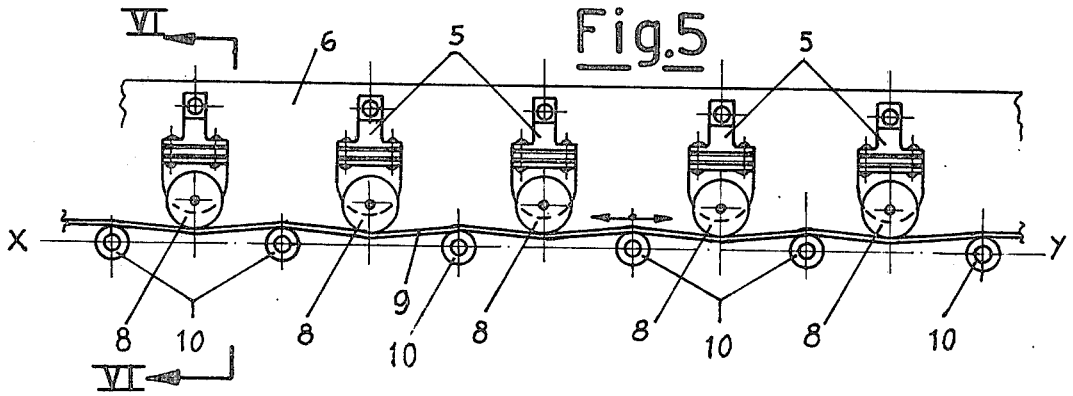
FIG. 5 is a plan view like that of FIG. 4 but with a tensioning device at every spindle.

As can be seen in this FIG. 4 there is provided a tensioning device after every couple of spindles, whilst in FIG. 5 there is illustrated the solution providing a tensioning device after every spindle.

Figure 6:
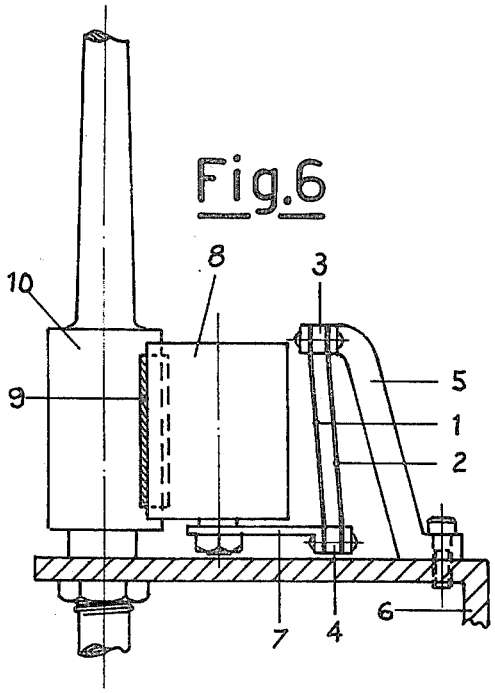
FIG. 6 represents a side view of the tensioning device in the working position, when it exerts the pressure upon the drive belt.

FIG. 6 is a section along the line VI—VI of FIGS. 4 and 5.

As said above, to get a stable pressure means it is necessary to avoid any possible vibrations of the pressing roller 8. It has also been explained how and why that inconvenience can be eliminated.

Figure 7:
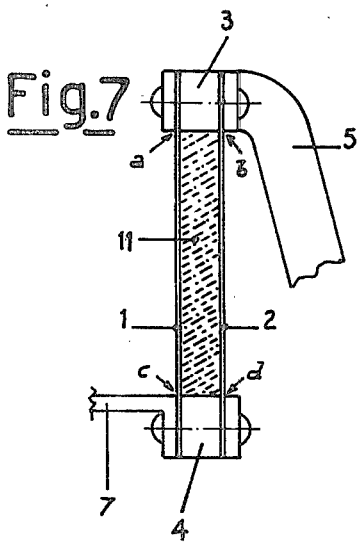
FIG. 7 is a side view of the parallelogram where in the space confined by the two belts and by the two spacers at the ends a parallelepiped of elastic material is inserted.

FIG. 7 shows the usual parallelogram formed by the members 1-2-3-4. The space confined by these members as represented by the points a-b-c-d is filled with a block 11 of elastic material, for instance of an elastomer or other similar material. Due to its lateral friction along the walls a-c and b-d and owing to the different molecular structure of the steel tapes on one hand and the elastic block 11 on the other hand there arise different resonances which cancel the vibrations.

Figure 8:
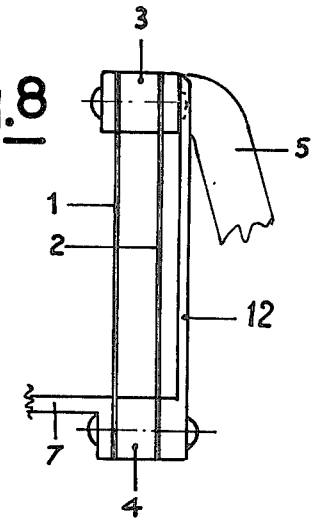
FIG. 8 represents a side view of the parallelogram with the diversion pointer in rest position.

In FIG. 8 the same parallelogram of FIGS. 1 and 7 is represented in the rest position with the same reference numerals of FIG. 1, but with the difference that a pointer 12 is rigidly connected to the lower spacer 4.

Figure 9:
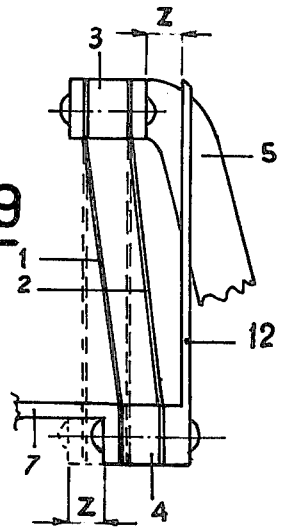
FIG. 9 represents a side view of the same parallelogram in operating position with the pointer indicating the diversion.

If by effect of the pressure to be exerted by the pressing roller, the free lower part 4 of the parallelogram is displaced by an amount "Z," as is shown in FIG. 9, also the upper part of the pointer 12 shifts by the same amount "Z" thereby allowing the evaluation or measurement of the diversion of the tapes 1, 2, of the parallelogram and thus enabling one to know or correct the pressure exerted by the pressing roller independently of the camber assumed by the belt.

The correcting adjustment can be carried out by adjusting the tension of the belt.

I claim:

1. A tensioning device for supporting a rotatable pressure roller in tangential engagement with a continuous drive belt running tangentially to a row of members aligned along a longitudinal axis of a machine, for instance spindles of a ring spinning machine or of a ring twisting machine or rotors of machines for open end spinning, for ensuring the adherence of the belt to the members to be driven in rotation, comprising a flexible support formed by two identical tapes of hardened steel and by two identical spacers secured in spaced relation between the ends of said tapes to fix the tapes in spaced, parallel relation to each other, a pressing roller rotatably mounted on one end of said support, and means fixing the other end of the support to a machine, said tapes being flexible to permit said one end of the support to move relative to its other end in such a way that the axis of the pressing roller is displaceable with said one end of the support parallel to itself.

2. A device according to claim 1, characterized in that the plane of displacement of the axis of the pressing roller is orthogonal to the axes of the members that are to be driven in rotation.

3. A device according to claim 1, characterized in that in the space circumscribed by the couple of tapes and by the two spacers there is positioned an elastic body which is rectangular in cross section, and which is deformable together with the tapes.

4. A device according to claim 1, characterized by a pointer on said movable end of the support for indicating the deflection of the steel tapes from their normal, unflexed positions.

* * * * *